US009325111B2

(12) United States Patent
Pierik et al.

(10) Patent No.: US 9,325,111 B2
(45) Date of Patent: Apr. 26, 2016

(54) ELECTRICAL CENTER AND CONNECTOR ASSEMBLY SYSTEM

(71) Applicant: Lear Corporation, Southfield, MI (US)

(72) Inventors: Bruce H. Pierik, Hazel Park, MI (US); Jonathan Dahlstrom, Highland, MI (US); Steven F. Gawron, Plymouth, MI (US)

(73) Assignee: Lear Corporation, Southfield, MI (US)

( * ) Notice: Subject to any disclaimer, the term of this patent is extended or adjusted under 35 U.S.C. 154(b) by 60 days.

(21) Appl. No.: 14/087,795

(22) Filed: Nov. 22, 2013

(65) Prior Publication Data

US 2014/0154898 A1 Jun. 5, 2014

Related U.S. Application Data

(60) Provisional application No. 61/731,544, filed on Nov. 30, 2012.

(51) Int. Cl.
*H01R 13/629* (2006.01)

(52) U.S. Cl.
CPC ..... *H01R 13/62966* (2013.01)

(58) Field of Classification Search
CPC ..... H01R 13/62938; H01R 13/62966
USPC ..... 439/76.2
See application file for complete search history.

(56) References Cited

U.S. PATENT DOCUMENTS

| | | | | |
|---|---|---|---|---|
| 2,430,011 | A | 11/1947 | Gillentine | |
| 5,788,529 | A * | 8/1998 | Borzi et al. | 439/364 |
| 5,873,745 | A * | 2/1999 | Duclos et al. | 439/157 |
| 6,254,414 | B1 | 7/2001 | Sawayanagi et al. | |
| 7,066,763 | B1 * | 6/2006 | Corwin et al. | 439/372 |
| 7,094,081 | B1 | 8/2006 | Senk et al. | |
| 7,241,154 | B1 | 7/2007 | Mauney et al. | |
| 7,670,159 | B2 * | 3/2010 | Shamoto et al. | 439/157 |
| 8,047,860 | B2 * | 11/2011 | Gladd et al. | 439/152 |
| 2010/0038133 | A1 * | 2/2010 | Senk et al. | 174/72 B |

* cited by examiner

*Primary Examiner* — Amy Cohen Johnson
*Assistant Examiner* — Matthew T Dzierzynski
(74) *Attorney, Agent, or Firm* — MacMillan, Sobanski & Todd, LLC

(57) ABSTRACT

An electrical junction box has a connector retainer assembly with a first contact surface, as well as a connector housing assembly with a pivotal lever arm. The lever arm has a first engagement surface. The connector retainer assembly and the connector housing assembly configured so that when the lever arm is moved in a single direction relative to the connector housing assembly, the first engagement surface engages the first contact surface and the connector housing assembly moves relative to the connector retainer assembly from a pre-staged position to an assembled position.

11 Claims, 16 Drawing Sheets

ELECTRICAL CENTER AND CONNECTOR ASSEMBLY SYSTEM

CROSS-REFERENCE TO RELATED APPLICATIONS

This application claims the benefit of U.S. Provisional Application No. 61/731,544, filed Nov. 30, 2012, the disclosure of which is incorporated herein by reference.

BACKGROUND OF THE INVENTION

This invention relates in general to connector assembly systems for electrical junction boxes, such as can be used to connect a plurality of electrical components provided in an automobile. More specifically, this invention relates to an improved structure for a connector assembly system for an electrical junction box as shown in the illustrated embodiments.

Electric vehicles and hybrid electric vehicles typically include a large number of electrical systems, including high-voltage systems such as drive motors. Electrical connections for these electrical systems are typically made in an electrical junction box. The electrical junction box allows multiple electrical connections to be made simultaneously when the electrical junction box is assembled. The electrical junction box also allows these electrical connections to be disconnected simultaneously when the electrical junction box is disassembled. This is advantageous because, for example, it allows all high-voltage systems on the vehicle to be disconnected at one place before maintenance work is done on the vehicle.

Because a large number of electrical connections can be made in the electrical junction box, and because high voltage connections can require large electrical connectors, a large amount of force may be required to assemble and disassemble the electrical junction box. This may also require the use of a specialized tool. It would be advantageous to have an electrical junction box that is easier to assemble.

SUMMARY OF THE INVENTION

This invention relates to an electrical junction box. The electrical junction box has a connector retainer assembly with a first contact surface. The electrical junction box also has a connector housing assembly including a pivotal lever arm, the lever arm having a first engagement surface. The connector retainer assembly and the connector housing assembly are configured so that when the lever arm is moved in a single direction relative to the connector housing assembly, the first engagement surface engages the first contact surface and the connector housing assembly moves relative to the connector retainer assembly from a pre-staged position to an assembled position.

This invention further relates to an electrical junction box with a connector retainer assembly and a connector housing assembly. The connector housing assembly includes a first pivotal lever arm and a second pivotal lever arm. The first lever arm and the second lever arm are arranged in a crossing configuration. The connector retainer assembly and the connector housing assembly are configured so that when the first lever arm and the second lever arm are moved in respective single directions relative to the connector housing assembly, the connector retainer assembly moves relative to the connector retainer assembly from a pre-staged position to an assembled position.

This invention further relates to an electrical junction box having a connector retainer assembly and a connector housing assembly. A first lever arm is pivotally connected to the connector housing assembly and a second lever arm is also pivotally connected to the connector housing assembly. The first lever arm and the second lever arm are arranged in a crossing configuration. A plurality of electrical terminals are mounted on the connector retainer assembly and a circuit board assembly is connected to the connector housing assembly. The connector retainer assembly and the connector housing assembly configured so that when the first lever arm and the second lever arm are moved in respective single directions relative to the connector housing assembly, the connector housing assembly moves relative to the connector retainer assembly from a pre-staged position to an assembled position. When the connector housing assembly is in a pre-staged position relative to the connector retainer assembly the electrical terminals are not mated with the circuit board assembly. When the connector housing assembly is in the assembled position relative to the connector retainer assembly the electrical terminals are mated with the circuit board assembly.

Various aspects of this invention will become apparent to those skilled in the art from the following detailed description of the illustrated embodiments, when read in light of the accompanying drawings.

DETAILED DESCRIPTION OF THE ILLUSTRATED EMBODIMENTS

Figure 1:
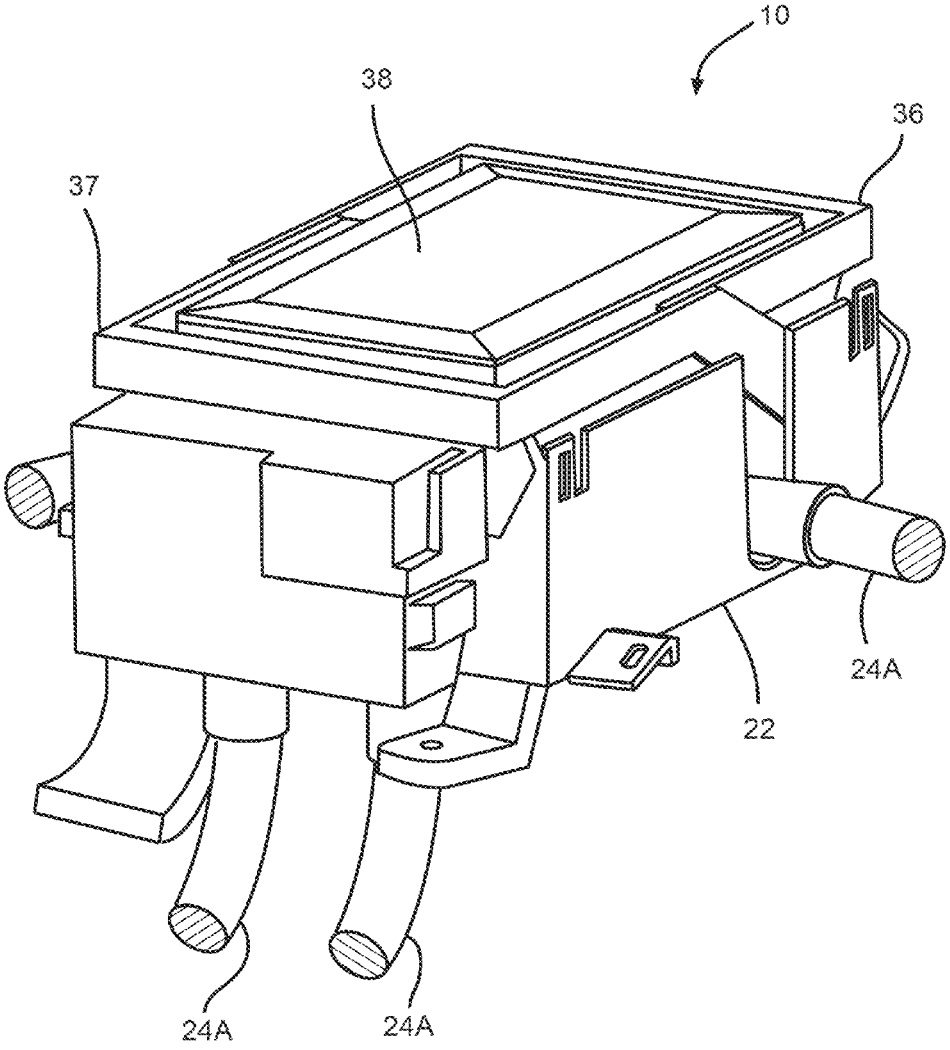
FIG. 1 is a perspective view of an electrical junction box, in accordance with a first illustrated embodiment.

Referring now to the drawings, there is illustrated in FIG. 1 an electrical junction box, indicated generally at 10, in accordance with a first illustrated embodiment. The illustrated electrical junction box 10 is suitable for use as an under-hood electrical center (UEC) in an automobile or other vehicle. Although the electrical junction box 10 will be described and illustrated in the context of an UEC, it should be appreciated that the electrical junction box 10 can be used in any other desired environment for providing electrical connections.

Figure 2:
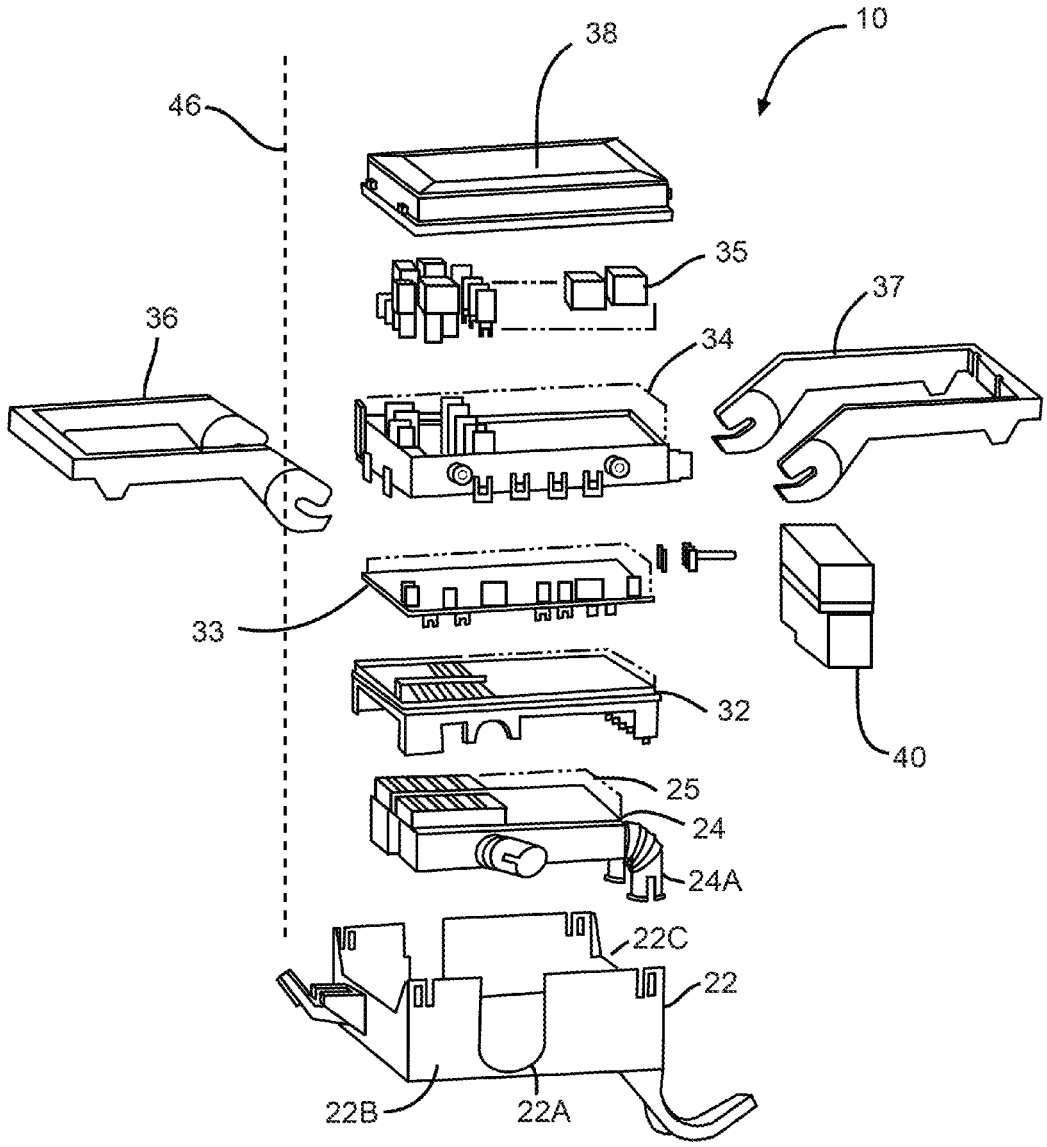
FIG. 2 is an exploded perspective view of the electrical junction box of FIG. 1.

Referring now to FIG. 2, an exploded view of the electrical junction box 10 is shown. The illustrated electrical junction box 10 includes a connector retainer assembly, indicated generally at 20 and a connector housing assembly, indicated generally at 30. The connector retainer assembly 20 includes a base 22 and a wire harness assembly 24. The connector housing assembly 30 includes a lower housing 32, a circuit board assembly 33, an upper housing 34, a plurality of electrical components 35, a first lever arm 36, a second lever arm 37, a cover 38, and a pre-fuse assembly 40. As will be described below, the first lever arm 36 and the second lever arm 37 allow an operator (not shown) to connect the components of the electrical junction box 10 by moving the assembled connector retainer assembly 20 and the assembled connector housing assembly 30 toward each other in an assembly direction indicated by the line 46.

The base 22 defines a generally open box-like structure having a bottom 22A and side walls 22B that extend from the base 22A to define an exposed base cavity 22C. The base 22 may have a shape or size different from that illustrated if desired, depending on the arrangement of electric components included in the electrical junction box 10, for example, as will be described below. The base 22 is made of a blow molded plastic, but may be made of any desired material. The wire harness assembly 24 includes a plurality of wire harnesses 24A and a plurality of electrical terminals 25, the purpose of which will be explained below. The wire harness assembly 24 is supported within the inner cavity 22C of the base 22. It should be appreciated that the side walls 22B of the base 22 define apertures to accommodate the wire harnesses 22A. It should further be appreciated that the arrangement of apertures in the base 22 may differ from that illustrated, in order to accommodate a desired arrangement of wire harnesses.

Figure 3:
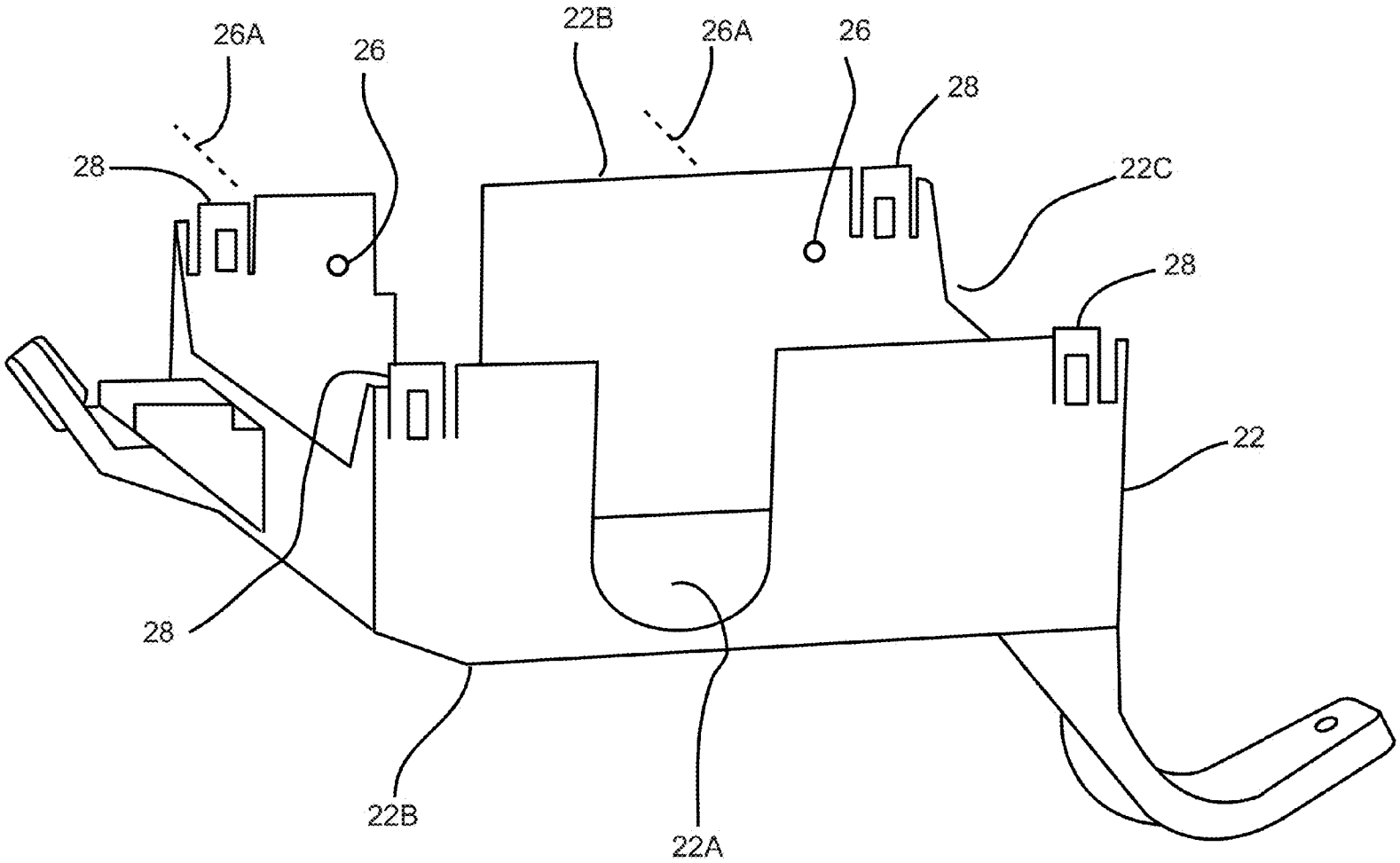
FIG. 3 is an enlarged perspective view of a base of the electrical junction box shown in FIG. 2.

Referring to FIG. 3, a perspective view of the base 22 is shown. The base 22 includes a plurality of latch pins 26. The illustrated base 22 includes two pair of latch pins 26, with one latch pin of each pair located on opposed side walls 22B (only one of each pair of latch pins 26 is visible in FIG. 3). Each pair of latch pins 26 defines a pin axis, 26A. The latch pins 26 are cylindrical members that extend generally perpendicular from the side walls 22B of the base 22. The pairs of latch pins 26 are engaged by the first lever arm 36 and the second lever arm 37 respectively when the connector housing assembly 30 is connected to the connector retainer assembly 20, as will be described below. The latch pins 26 may have a different shape that is suitable for this purpose, if desired. The illustrated latch pins 26 are molded as part of the base 22. Alternatively, the latch pins 26 may be separate components that are connected to the base 22, if desired.

The base 22 further includes a plurality of optional retaining latch members 28. The retaining latch members 28 are resilient, yet flexible tongues that extend upwardly from the side walls 22B of the base 22. The retaining latch members 28 provide retainers for the first level arm 36 and the second lever arm 37 on the assembled electrical junction box 10, as will be described below. In the illustrated embodiment, a pair of retaining latch members 28 is respectively provided on each of the side walls of the base 22, for a total of four retaining latch members 28. The base 22 may, however, include any number or configuration of retaining latch members 28 as desired. As shown in FIG. 3, the retaining latch members 28 are generally C-shaped tabs that define an aperture that extends therethrough.

Figure 4:
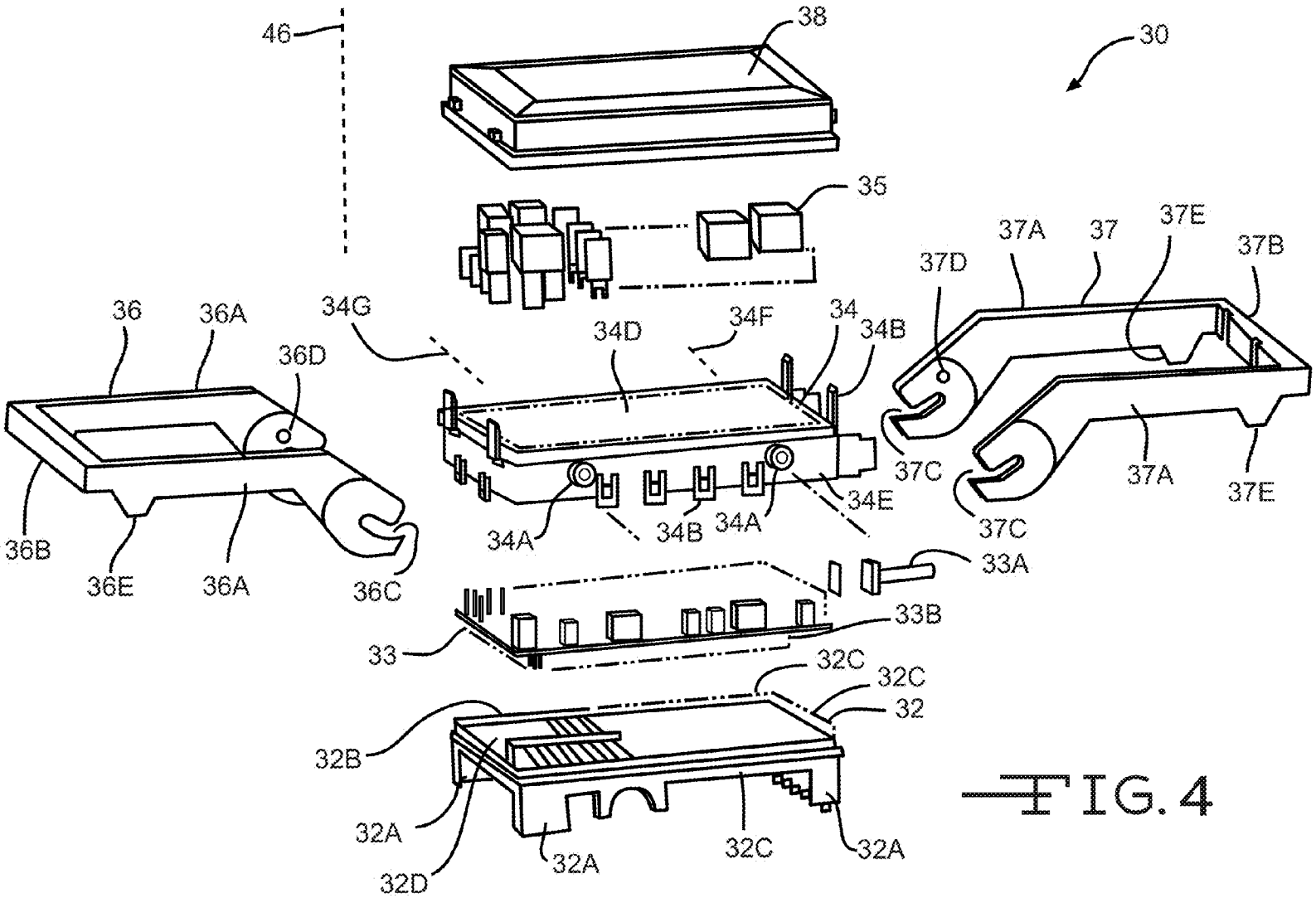
FIG. 4 is an exploded perspective view of a connector housing assembly of the electrical junction box shown in FIG. 2.
Figure 5:
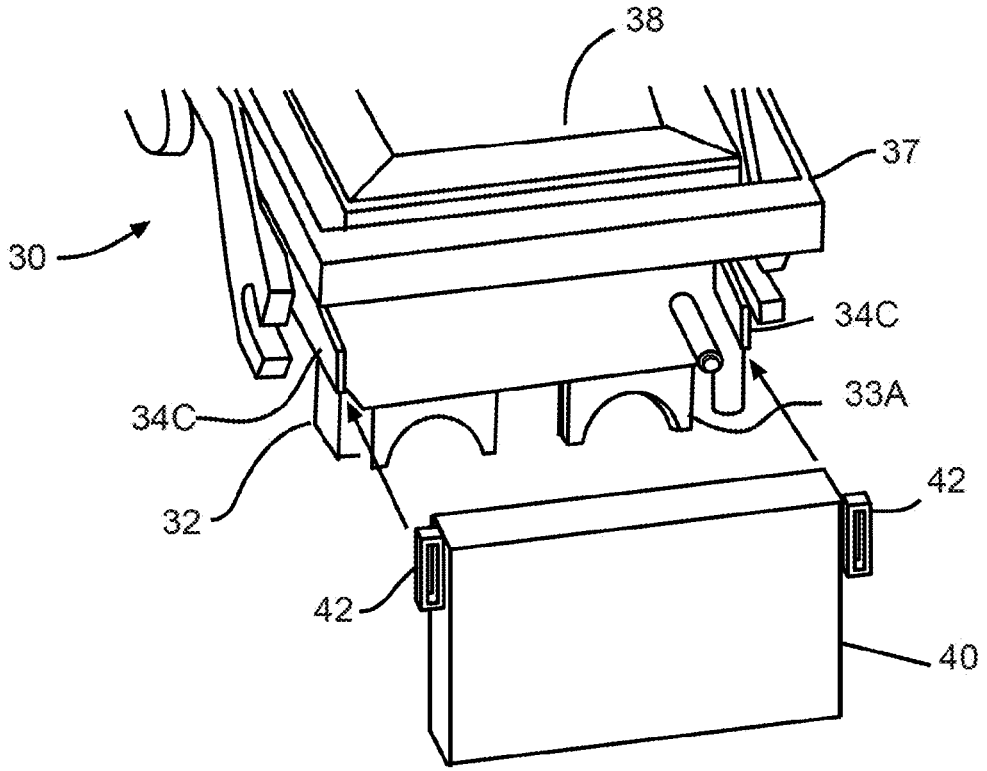
FIG. 5 is a perspective view of the connector housing assembly in FIG. 4 partially assembled with a pre-fuse assembly shown in an unassembled position.

Referring now to FIG. 4, the connector housing assembly 30 is shown. The illustrated lower housing 32 is a generally open box-like structure having a base 32B and a plurality of side walls 32C that define an inner cavity 32D. The base 32B of the lower housing 32 defines a plurality of apertures that extend there through, in order to accommodate the components of the circuit board assembly 33. Optional guide posts 32A are provided at each corner of the lower housing 32. The illustrated guide posts 32A extend from the lower housing 32 generally perpendicular to the base 32B. The guide posts 32A are received within the corners of the base 22 when the electrical junction box 10 is assembled (as described below) in order to facilitate proper alignment of the connector housing assembly 30 and the connector retainer assembly 20.

The printed circuit board assembly 33 includes a plurality of printed circuits 33B. It should be appreciated that the printed circuit board assembly 33 can be tailored for a specific application. Although the illustrated embodiment describes a plurality of printed circuits, it should be appreciated that the printed circuit board assembly 33 and the electrical components 35 may be replaced with any other desired electrical components that are to be connected to the electrical terminals 25. As will be explained below, an electrically conductive stud 33A is supported on the printed circuit board assembly 33 and extends there from.

The illustrated upper housing 34 is an open box-like structure that includes a housing surface 34D and side walls 34E that extend generally perpendicularly to the housing surface 34D to define an exposed inner cavity. The upper housing 34 may, however, have any shape or configuration as desired. The upper housing 34 defines two pair of support apertures 34A on opposed side walls thereof (only one of each pair of support apertures 34A is visible in FIG. 4). One pair of support apertures 34A defines a first support axis 34F and the second pair of support apertures 34A defines a second support axis 34G. Each pair of support apertures 34A pivotally supports one of the first lever arm 36 and the second lever arm 37 for rotation relative to the upper housing 34.

The upper housing 34 includes a plurality of retaining features provided on the housing surface 34D to support the electrical components 35. The electrical components 35 can be fuses, relays, or other desired electrical components that engage with the printed circuits 33B of the circuit board assembly 33. The illustrated upper housing 34 further includes a plurality of latch members 34B that extend upwardly from the housing surface 34D and downwardly from the side walls 34E. The latch members 34B serve to provide a snap fit to secure to the upper housing 34 to the lower housing 32 and to the cover 38 when the electrical junction box 10 is assembled. The upper housing 34 may have a different number or configuration of latch members 34B from that illustrated, if desired.

The cover 38 is secured to the upper housing 34 when the electrical junction box 10 is assembled in order to protect the electrical components 35. The illustrated cover is made of blow molded plastic, but may be made of any other desired material.

The first lever arm 36 and the second lever arm 37 are substantially similar to one another; therefore, only the first lever arm 36 will be described in detail. Components of the second lever arm 37 that are similar to components of the first lever arm 37 will be labeled with the same letter with the prefix "37." The lever arm 36 includes a pair of side arms 36A that are free at their proximal ends and connected by a handle 36B at their distal ends. The illustrated proximal ends of each side arm 36A defines a single cam slot 36C formed therein. The cam slot 36C defines a curved path, the purpose of which will be explained below. A pair of pivot pins 36D is respectively provided on opposing inner surfaces of each side arm 36A so as to be coaxially aligned with one another (only one of the pivot pins 36D is visible in FIG. 4). The pivot pins 36D are located near the inner surface of the curved cam slots 36C, respectively. The lever arm 36 includes a pair of locking protrusions 36E that is respectively provided on outer surfaces of the side arms 36A. The locking protrusions 36E engage the latch members 28 on the base 22 (shown in FIG. 3) when the electrical junction box 10 is assembled in order to retain the first lever arm 36 in position. It should be appreciated that the first lever arm 36 and the second lever arm 37 are not limited to the illustrated embodiment, but may have any desired shape or configuration as desired.

Referring now to FIGS. 2 through 4, assembly of the connector housing assembly 30 will be described. As best seen in reference to FIG. 4, the electrical conductive stud 33A is connected to the printed circuit board assembly 33 and the printed circuit board assembly 33 is placed into inner cavity 32D of the lower housing 32. The upper housing 34 is connected to the lower housing 32 and snap-fit thereto by the lower latch members 34B. As such, the printed circuit board assembly 33 is enclosed by lower housing 32 and the upper housing 34. The electrical components 35 are connected to the housing surface 34D of the upper housing 34 and are placed into contact with the printed circuit board assembly 33 through the housing surface 34D of the upper housing 34.

Figure 6:
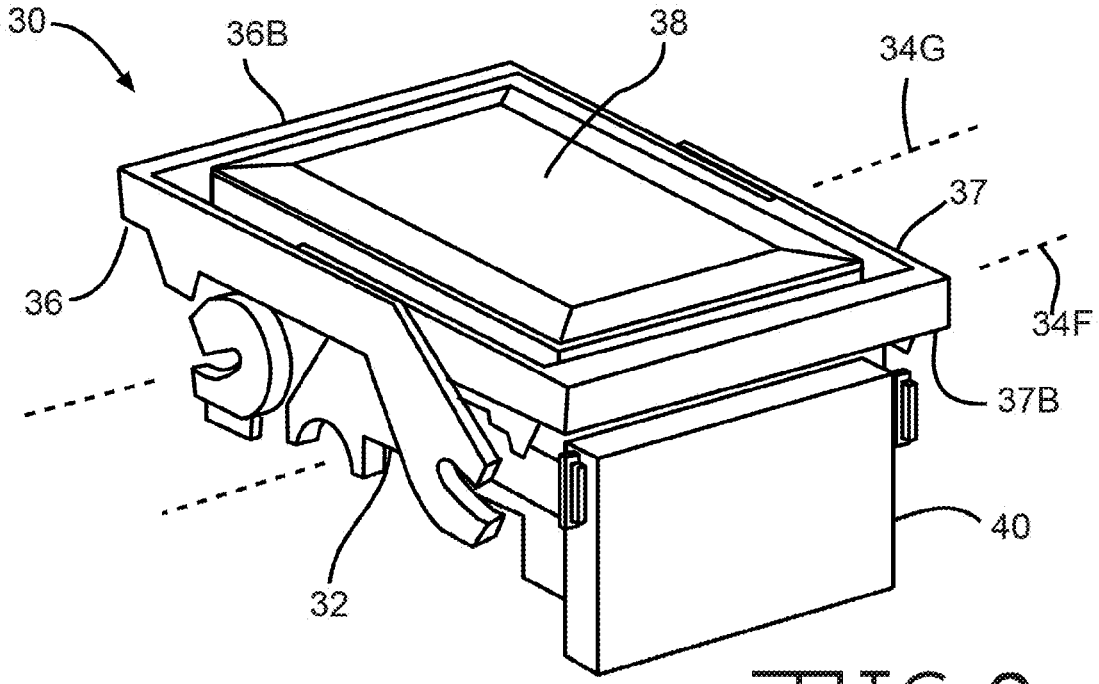
FIG. 6 is a perspective view of the connector housing assembly of FIG. 4 with the pre-fuse assembly shown in an assembled position.
Figure 7:
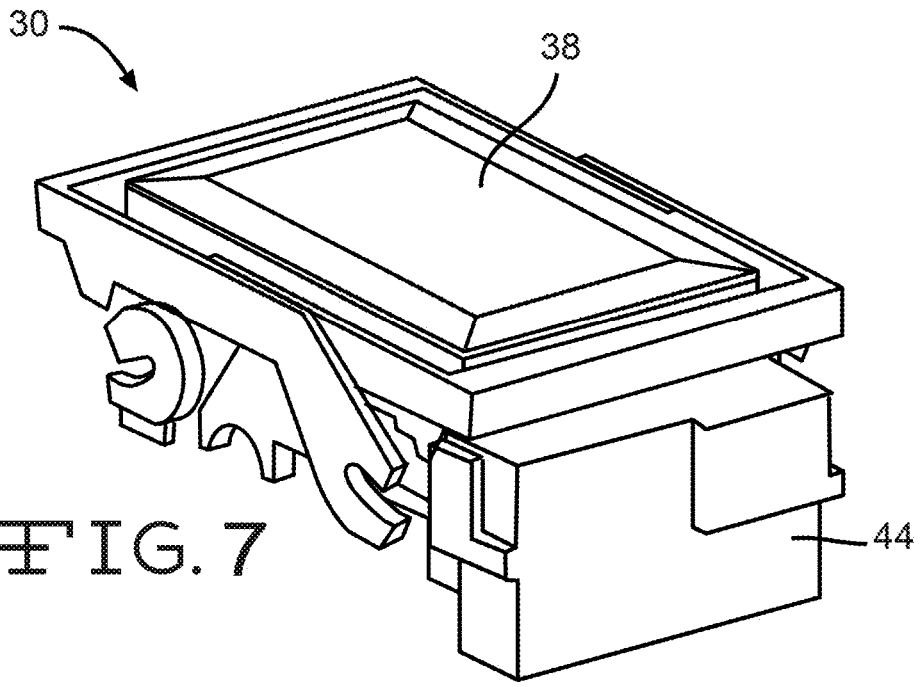
FIG. 7 is a perspective view of the connector housing assembly in FIG. 6 with a cover attached to the pre-fuse assembly.
Figure 8:
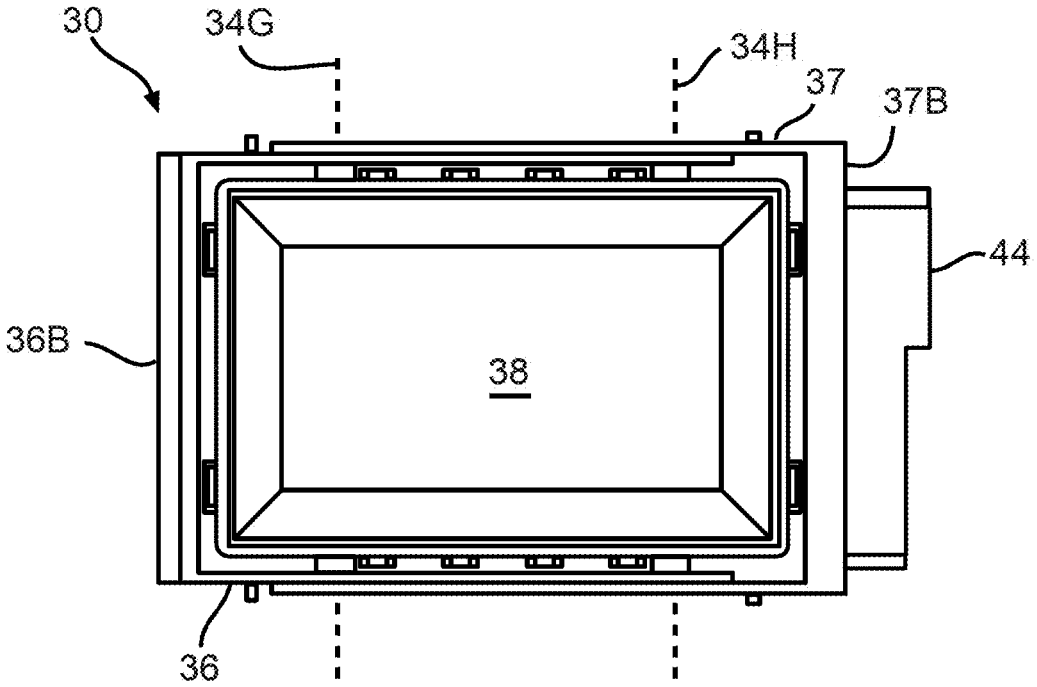
FIG. 8 is a top view of the connector housing assembly in shown in FIG. 7.

The first lever arm 36 and the second lever arm 37 are pivotally connected to the upper housing 34. The pair of pivot pins 36D on the first lever arm 36 are inserted into a pair of support apertures 34A so that the pivot pins 36D are located on the first support axis 34F. Similarly, the pair of pivot pins 37D on the second lever arm 37 are inserted into the other pair of support apertures 34A so that the pivot pins 37D are located on the second support axis 34G. As best seen in FIGS. 6 through 8, the first lever arm 36 and the second lever arm 37 are arranged in a crossing configuration. That is, in a direction that is perpendicular to the assembly direction 46 and perpendicular to the first support axis 34F, the second support axis 34G is located between the first support axis 34F and the handle 36B of the first lever arm 36. Similarly, the first support axis 34F is located between the second support axis 34G and the handle 37B of the second lever arm 37. It should be appreciated that this configuration provides an increased length of the first lever arm 36 and the second lever arm 37 as compared to a non-crossed lever arm configuration.

The cover 38 is connected to the upper housing 34 to enclose the electrical components 35. The cover 38 can be secured to the upper housing 34 by the upper latch members 34B.

As best shown in FIG. 5 through 8, the pre-fuse assembly 40 is connected to the connector housing assembly 30. The pre-fuse assembly 40 defines a pair of slots 42 on opposite sides thereof that receive latch tabs 34C that extend from the upper housing 34. This allows a snap-fit connection between the upper housing 34 and the pre-fuse assembly 40. It should be appreciated that the pre-fuse assembly 40 may be attached to the upper housing 34 using some other suitable connector, if desired. As shown in FIGS. 7 and 8, an optional pre-fuse cover 44 may be secured over the pre-fuse assembly 40. In this position, the connector housing assembly 30 may be packaged as a unit if desired.

Figure 9:
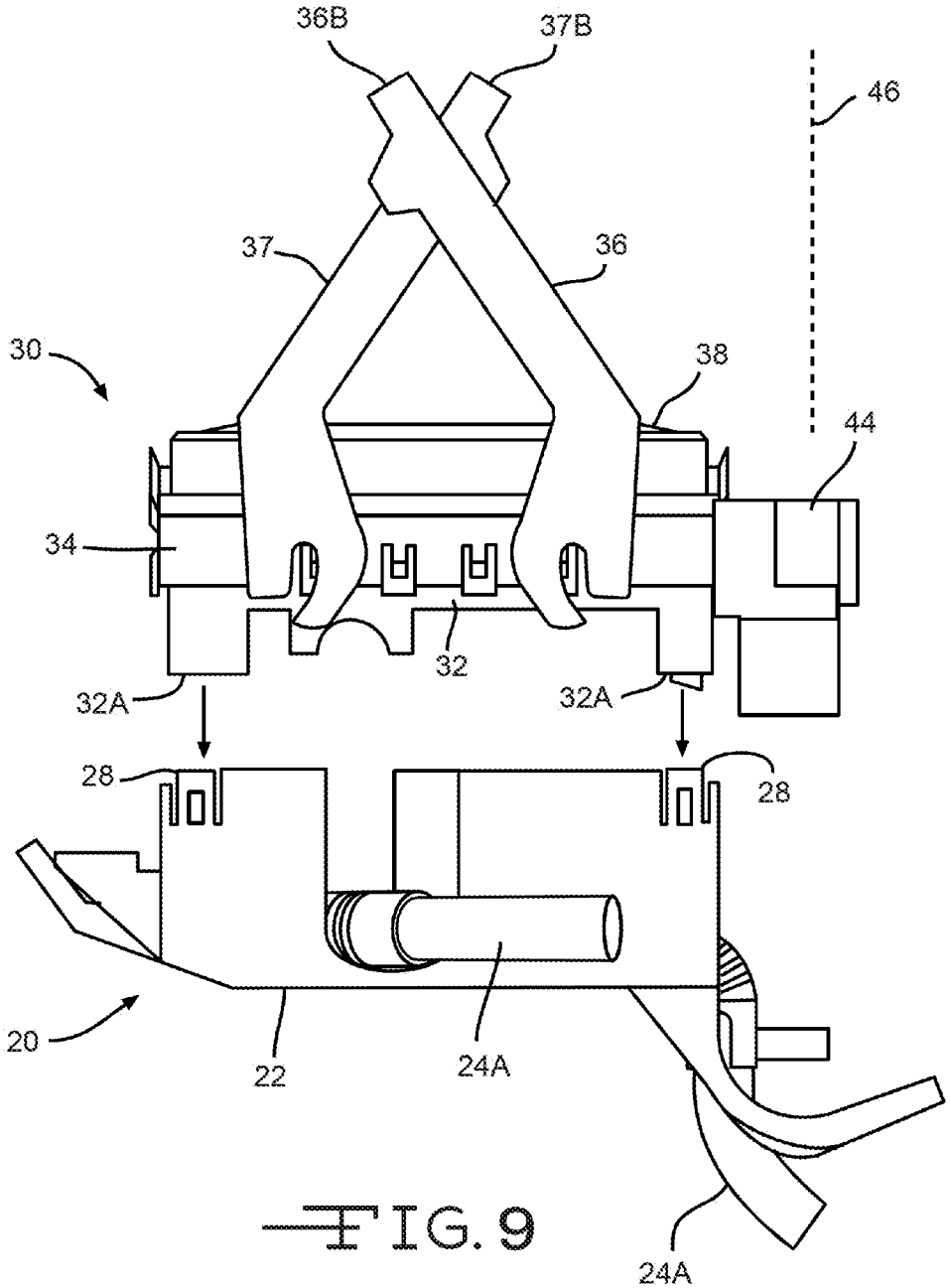
FIG. 9 is a side elevational view of the electrical junction box in FIG. 1 shown in an unassembled position.

Referring now to FIGS. 9 through 12, the operation of the first lever arm 36 and the second lever arm 37 will be described. As shown in FIG. 9, the connector retainer assembly 20 has been assembled, and the connector housing assembly 30 has been assembled. The first lever arm 36 and the second lever arm 37 are in respective raised positions. The connector housing assembly 30 is positioned above the connector retainer assembly 20 and is moved in the assembly direction 46 into contact with the connector retainer assembly 20. The guide posts 32A on the lower housing 32 are received within corners of the base 22. This facilities proper alignment of the connector housing assembly 30 relative to the connector retainer assembly 20.

Figure 10:
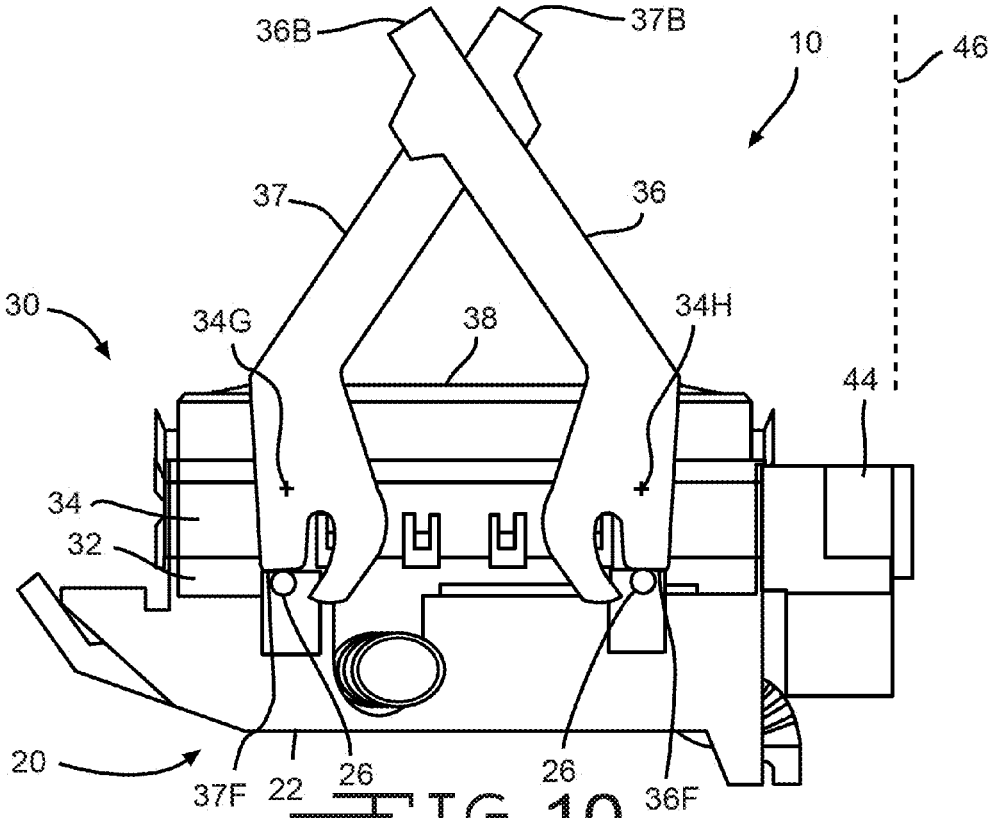
FIG. 10 is a side elevational view of the electrical junction box in FIG. 1 shown in a pre-staged position, with the connector base in partial cross-section.

Referring now to FIG. 10, the connector housing assembly 30 is shown in a pre-staged position. The side wall 22B of the base 22 is not shown in FIGS. 10 and 11 so that the engagement of the first lever arm 36 with the latch pin 26 is visible. A proximal end 36F of the first lever arm 36 is in contact with a latch pin 26 of the base 22. It should be appreciated that the other side arm of the first lever arm 36 (which is not visible in FIG. 10) is in contact with the opposed latch pin 26. With the connector housing assembly 30 in the pre-staged position, the operator can move the handle 36B of the first lever arm 36 and handle 37B of the second lever arm 37 generally away from each other. This causes the first lever arm 36 and the second lever arm 37 to rotate about the first support axis 34F and the second support axis 34G respectively, relative to the connector housing assembly 30. This motion is indicated by the arrows 48 in FIG. 11.

Figure 11:
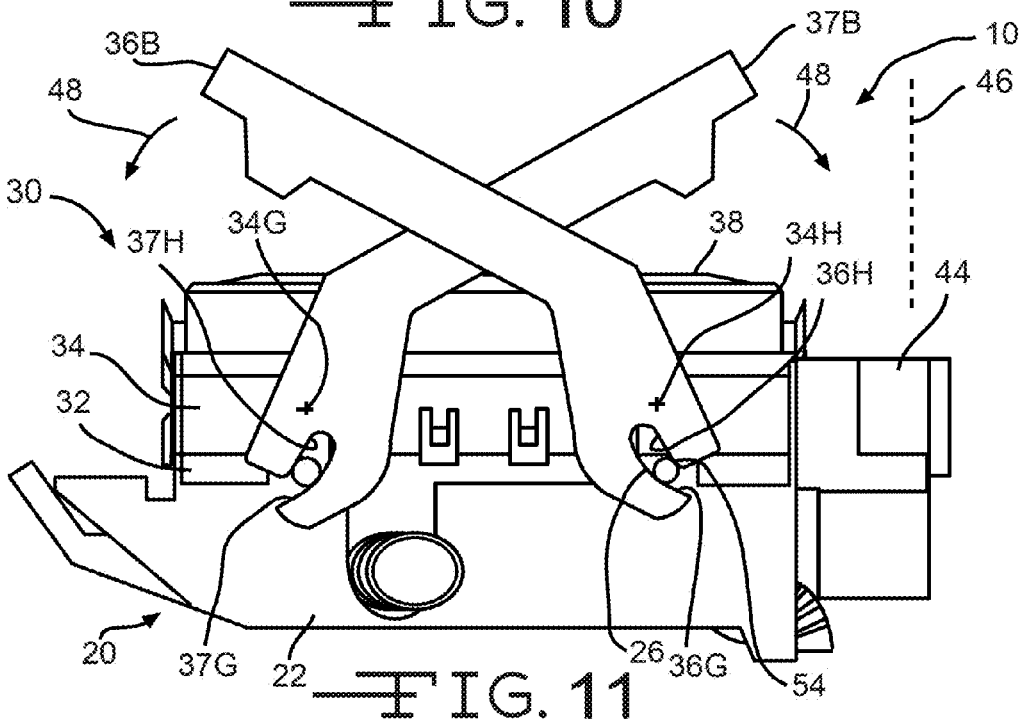
FIG. 11 is a side elevational view of the electrical junction box similar to that shown in FIG. 10, shown moved away from the pre-staged position and toward an assembled position.

The first lever arm 36 includes an engagement surface 36G adjacent the cam slot 36C. As the first lever arm 36 is rotated away from the raised position, the engagement surface 36G engages a contact surface 52 of the latch pin 26 and guides the latch pin 26 into the cam slot 36C, as shown in FIG. 11. Because the first lever arm 36 is attached to the upper housing 34 at the support aperture 34A, and the latch pin 26 is engaged with the cam slot 36C, further movement of the first lever arm 36 in the direction indicated by arrow 48 causes the upper housing 34 and the lower housing 32 to be drawn together in the assembly direction 46. This allows the upper housing 34 and the lower housing 32 to be drawn into mating engagement from the pre-staged position by pivoting the first lever arm 36 in a single motion in a single direction 48. It should be appreciated that the second lever arm 37 can be rotated at the same time as the first lever arm 36 in order to increase the force drawing the upper housing 34 and the lower housing 32 together, and to distribute the force across the electrical junction box 10.

Figure 12:
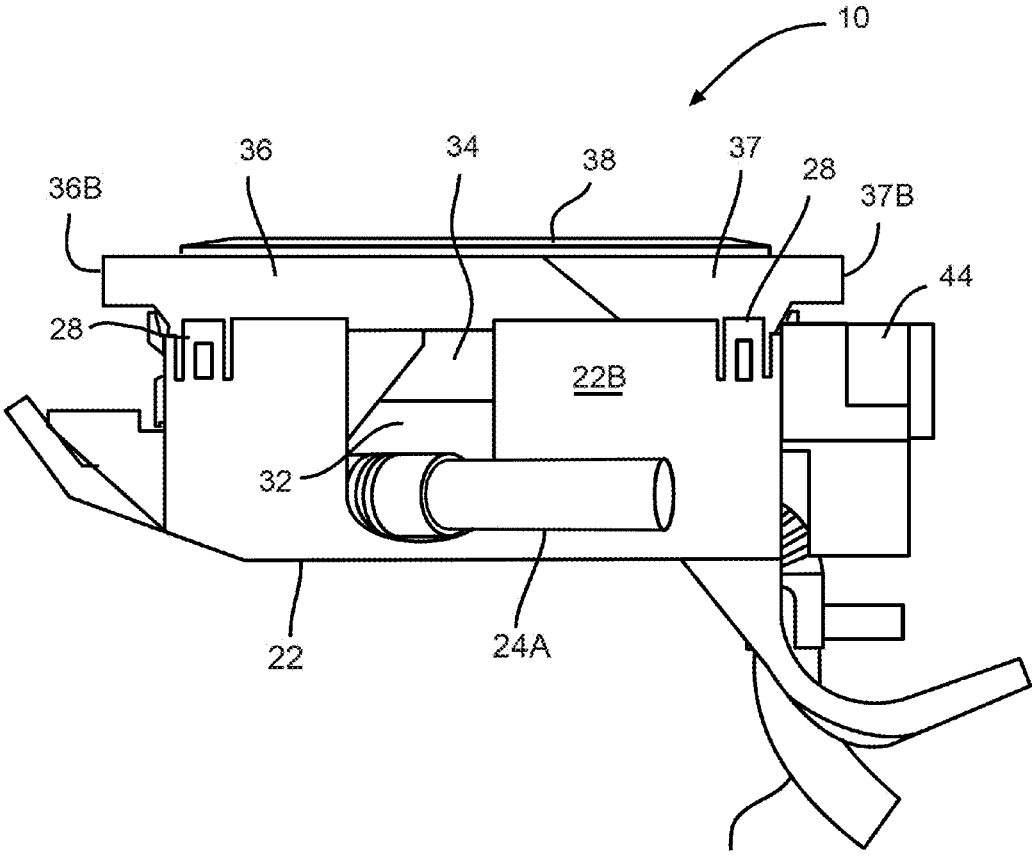
FIG. 12 is a side elevational view of the electrical junction box in FIG. 1 shown in the assembled position.

Referring now to FIG. 12, the electrical junction box 10 is shown when the connector housing assembly 30 is in an assembled position. The connector housing assembly 30 is engaged with the connector retainer assembly 20, and the first lever arm 36 and the second lever arm 37 are in their respective lowered positions. When the connector housing assembly 30 is in the assembled position, the electrical terminals 25 (best seen in FIG. 2) are mated with the circuit board assembly 33 and electrical connections are established between the wire harness assembly 24 and the electrical components 35. It should be appreciated that the first lever arm 36 is retained in the lowered position by the engagement of the locking protrusion 36E with the latch member 28 on the base 22.

The first lever arm 36 and the second lever arm 37 may be moved from the lowered positions shown in FIG. 12 to the raised positions shown in FIG. 10. A second contact surface 54 (best seen in FIG. 11) of the latch pin 26 will engage a removal surface 36H of the cam slot 36C, causing the connector housing assembly 30 and the connector retainer assembly 20 to be pushed apart in the assembly direction 46 until the connector housing assembly 30 is in the pre-staged position shown in FIG. 10. When the connector housing assembly 30 is in the pre-staged position, the electrical terminals 25 are not mated with the circuit board assembly 33 and electrical connections are not established between the wire harness assembly 24 and the electrical components 35. It should be appreciated that this is accomplished by moving the first lever arm 36 in a single motion in a second single direction opposite the direction 48. However, it should be appreciated that when the connector housing assembly 30 is in the pre-stage position, some components of the circuit board assembly 33 may still be in physical contact with the wire harness assembly 24. Once in the pre-staged position, the connector housing assembly 30 may be lifted away from the connector retainer assembly 20.

Figure 13:
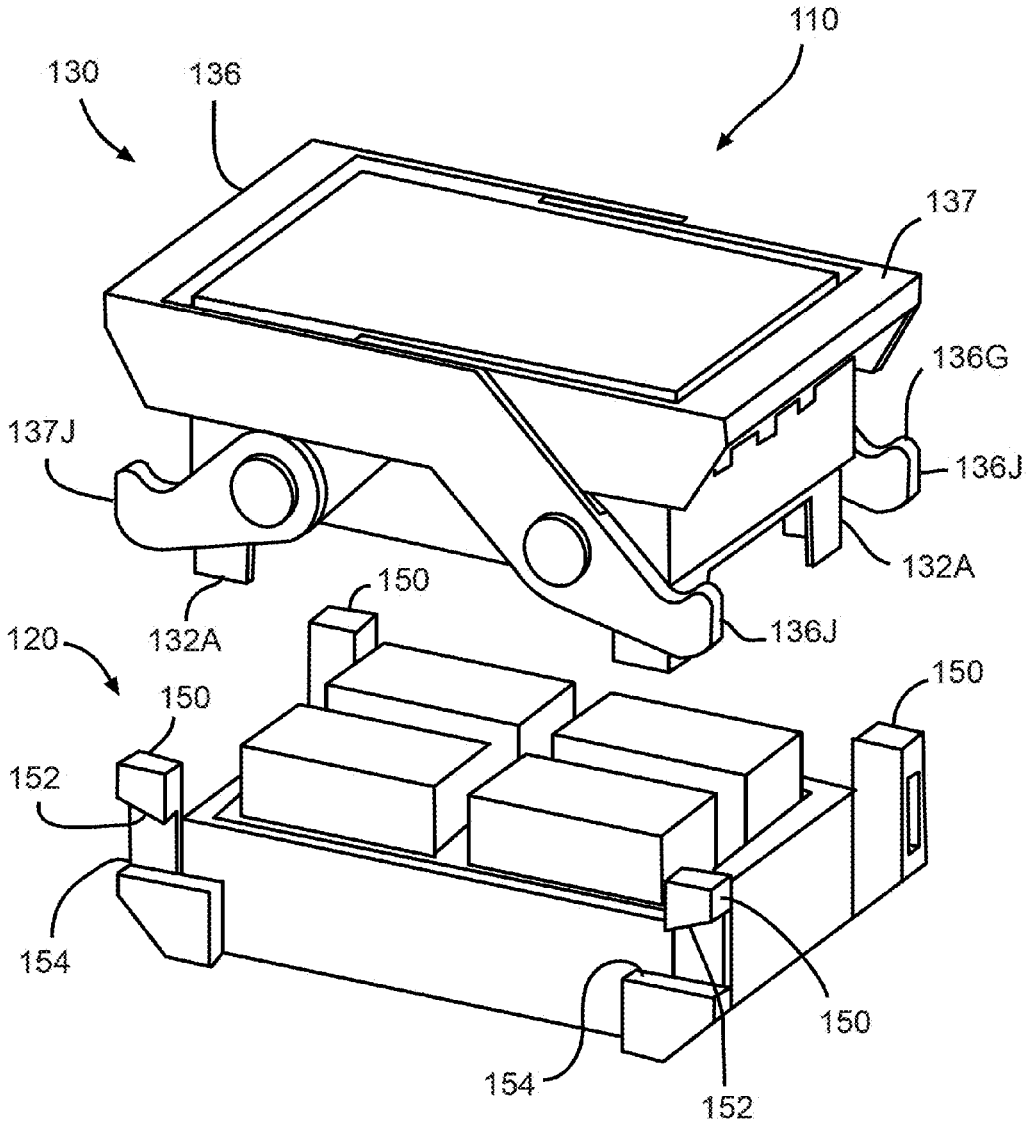
FIG. 13 is a perspective view of an alternative electrical junction box shown in an unassembled position. The alternative electrical junction box has lever arms with a different configuration from that of the electrical junction box shown in FIG. 1.

Referring now to FIG. 13, an alternative electrical junction box, indicated generally at 110, in accordance with a second embodiment is shown. The alternative electrical junction box 110 may include any structural features as described and illustrated above in the previous embodiments, although such is not required. Similar features have been numbered with common reference numerals but have been increased by 100 (e.g. 120, 130, 140, etc.). It should be appreciated that similar features are structured similarly, operate similarly, and/or have the same function unless otherwise indicated by the drawings or this specification.

The alternative electrical junction box 110 includes a connector retainer assembly 120 and a connector housing assembly 130. The connector retainer assembly 120 includes a plurality of latch posts 150, one at each corner of the connector retainer assembly 120. Each latch post 150 defines an upper contact surface 152 and a lower contact surface 154, the purpose of which will be explained below. As shown, the upper contact surface 152 is angled relative to the lower contact surface 154, although the contact surfaces 152 and 154 can be configured in any manner.

The illustrated connector housing assembly 130 includes a first lever arm 136 and a second lever arm 137. The first lever arm 136 and the second lever arm 137 are pivotally connected to the connector housing assembly 130 in a crossing configuration, as described above in the first embodiment. The distal ends of the first lever arm 136 and the second lever arm 137 respectively define hook portions 136J and 137J. It should be appreciated that the hook portions 136J and 137J can be shaped and otherwise configured different from the particular illustrated embodiment, if desired.

Figure 14:
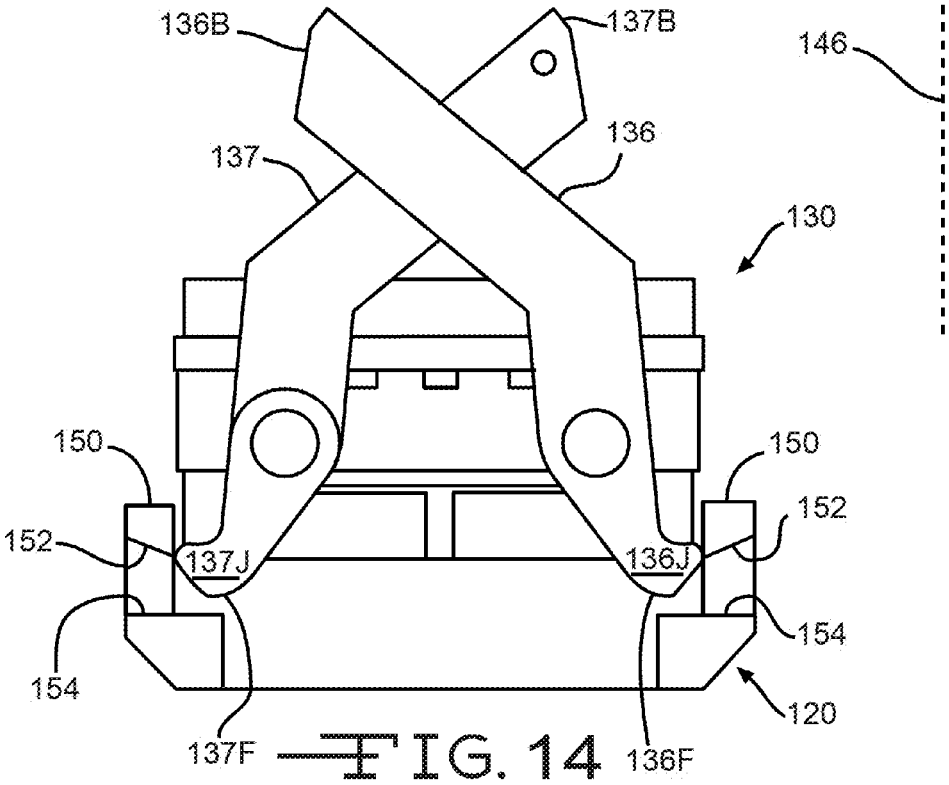
FIG. 14 is a side elevational view of the electrical junction box of FIG. 13 shown in a pre-staged position.

Referring now to FIGS. 14 through 18, the operation of the first lever arm 136 and the second lever arm 137 will be described. As shown in FIG. 14, the connector retainer assembly 120 has been assembled, and the connector housing assembly 130 has been assembled. The first lever arm 136 and the second lever arm 137 are in respective raised positions. The connector housing assembly 130 is positioned above the connector retainer assembly 120 and is moved in an assembly direction 146 into contact with the connector retainer assembly 120. Guide posts 132A (shown on FIG. 13) on the lower housing 132 are received within corners of the base 122. This facilities proper alignment of the connector housing assembly 130 relative to the connector retainer assembly 120. The connector housing assembly 130 is moved toward the connector retainer assembly 120 until a proximal end 136F of the hook portion 136J is in contact with the lower contact surface 154. The connector housing assembly 130 is then in a pre-staged position.

Figure 15:
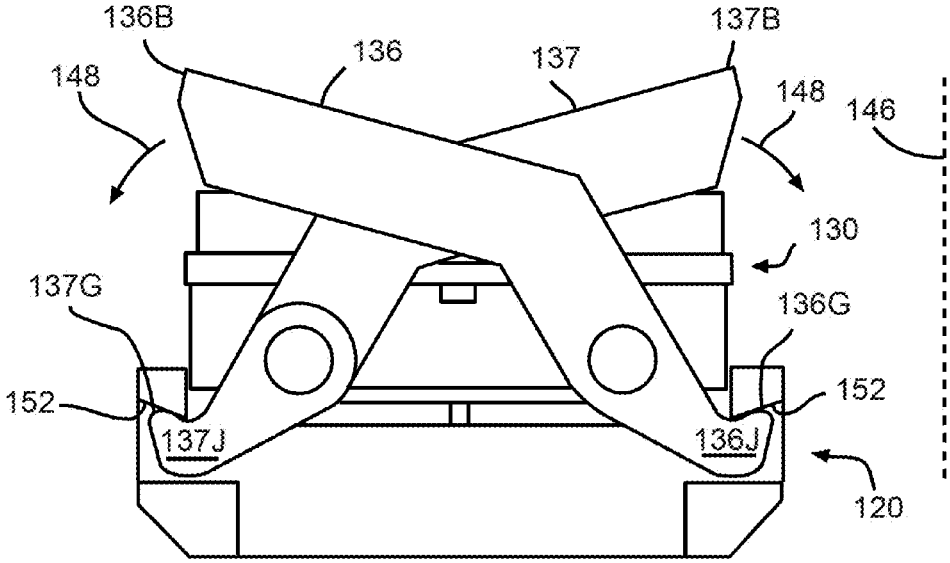
FIG. 15 is a side elevational view of the electrical junction box in FIG. 13 shown in a partially assembled position.

Referring now to FIG. 15, the operator can move a handle 136B of the first lever arm 136 and a handle 137B of the second lever arm 137 generally away from each other. This causes the first lever arm 136 and the second lever arm 137 to rotate relative to the connector housing assembly 130. This motion is indicated by the arrows 148. Rotation of the first lever arm 136 causes an engagement surface 136G of the hook portion 136J to engage the upper contact surface 152. This causes the upper housing 134 and the lower housing 132 to be drawn into mating engagement. This allows the upper housing 134 and the lower housing 132 to be drawn into mating engagement from the pre-staged position by pivoting the first lever arm 136 in a single motion in a single direction 148.

Figure 16:
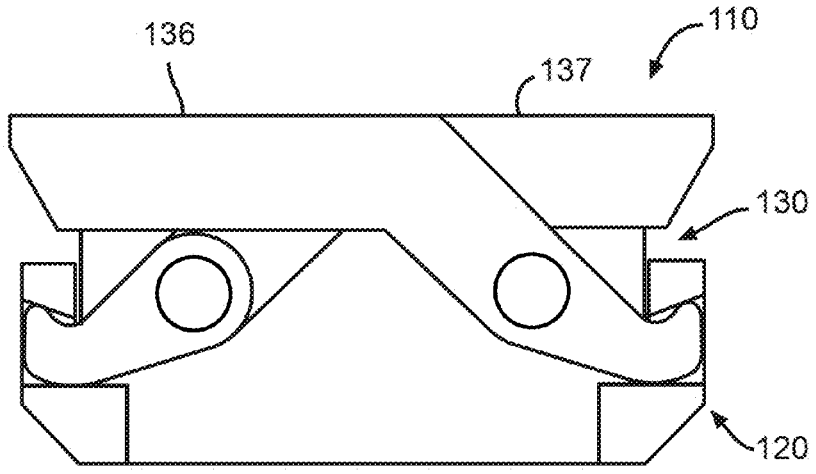
FIG. 16 is a side elevational view of the electrical junction box in FIG. 13 shown in an assembled position.

Referring now to FIG. 16, the connector housing assembly 130 is in an assembled position. The connector housing assembly 130 is engaged with the connector retainer assembly 120 and the first lever arm 136 and the second lever arm 137 are in their respective lowered positions.

Figure 17:
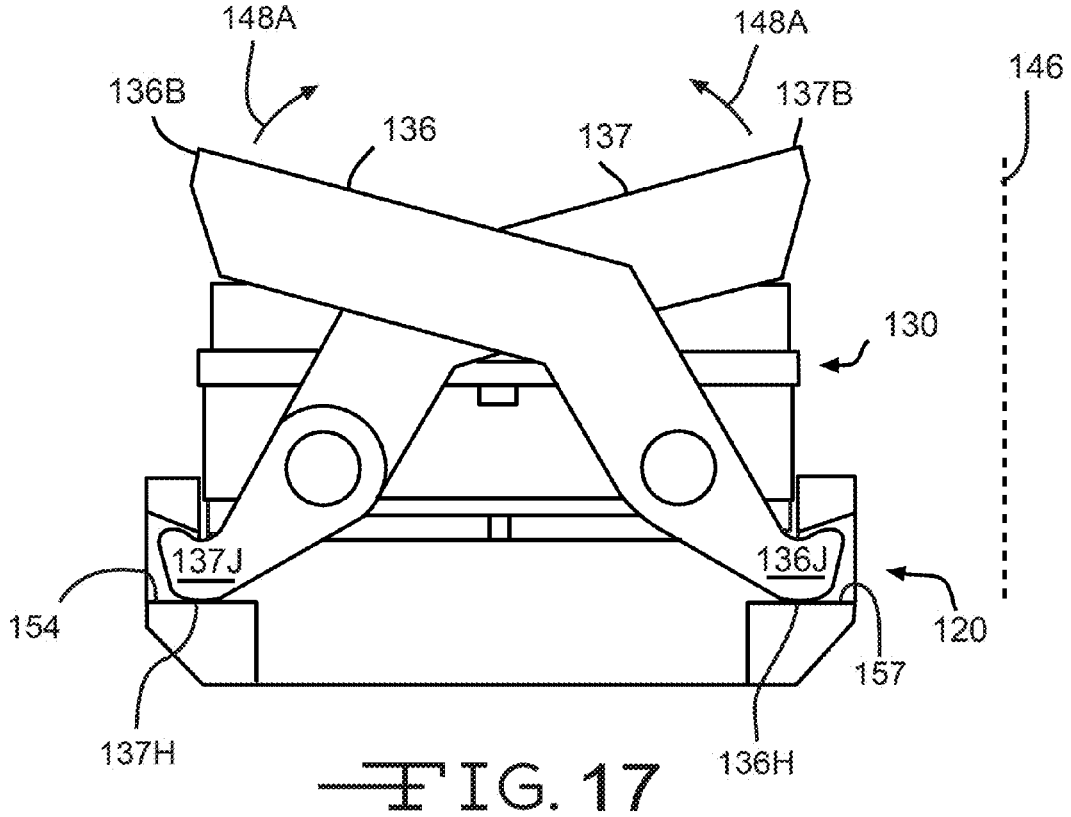
FIG. 17 is a side elevational view of the electrical junction box in FIG. 13 shown in a partially unassembled position.
Figure 18:
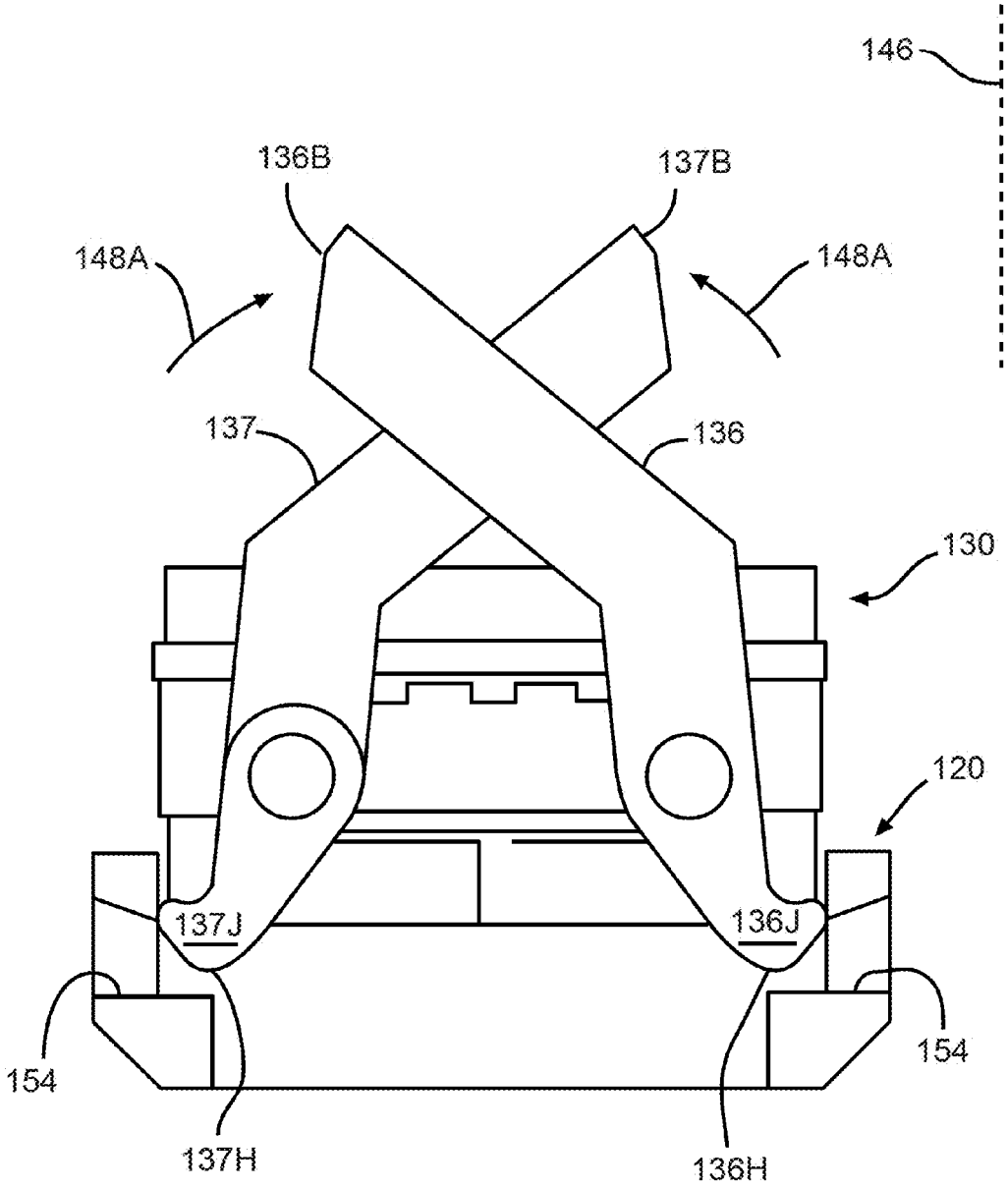
FIG. 18 is a side elevational view of the electrical junction box in FIG. 13 shown in a further partially unassembled position.

As shown in FIGS. 17 and 18, the connector housing assembly 130 can be disassembled from the connector retainer assembly 120 by moving the first lever arm 136 and the second lever arm 137 in a second direction 148A generally toward each other. It should be appreciated that the second direction 148A is opposite the direction 148. When the first lever arm 136 is moved in this direction, a removal surface 136H of the hook portion 136J engages the lower contact surface 154. This applies a force that pushes the connector housing assembly 130 and the connector retainer assembly 120 apart in the assembly direction 146, until the connector housing assembly 130 is in the pre-staged position. At this point, the connector housing assembly 130 is no longer engaged with the connector retainer assembly 120, and may be removed.

Figure 19:
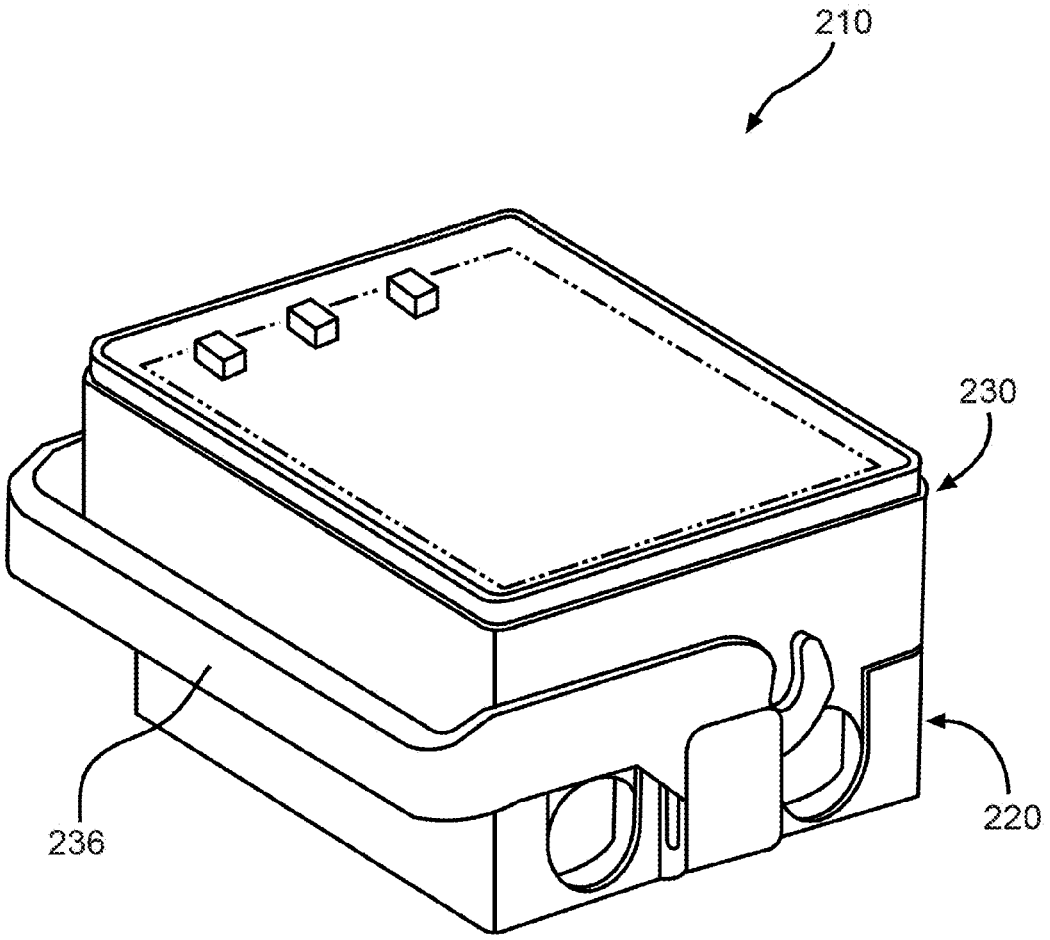
FIG. 19 is a perspective view of a second alternative electrical junction box shown in an assembled position. The second alternative junction box is similar to the electrical junction box of FIG. 1, but only has a single lever arm.
Figure 20:
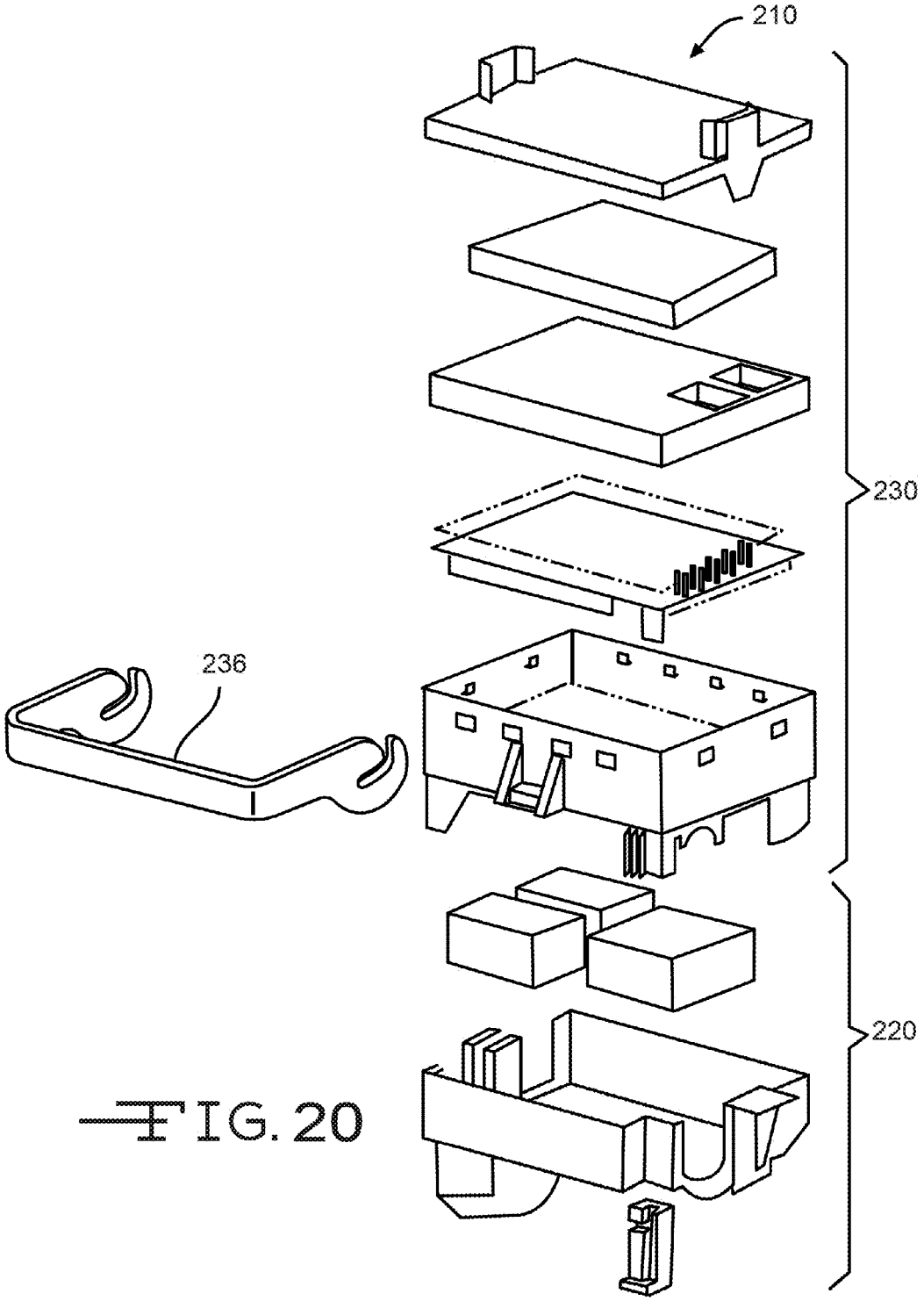
FIG. 20 is an exploded perspective view of the electrical junction box of FIG. 19.

Referring now to FIGS. 19 and 20, there is illustrated an second alternative electrical junction box, indicated generally at 210, in accordance with a third illustrated embodiment. The second alternative electrical junction box 210 may include any structural features as described and illustrated above in the previous embodiments, although such is not required. Similar features have been numbered with common reference numerals but have been increased by 200 (e.g. 220, 230, 240, etc.). It should be appreciated that similar features are structured similarly, operate similarly, and/or have the same function unless otherwise indicated by the drawings or this specification.

As shown in FIG. 20, the second alternative electrical junction box 210 includes a connector retainer assembly 220 and a connector housing assembly 230. The connector housing assembly 230 includes a single lever arm 236, as opposed to a pair of lever arms seen in the previous embodiments. The single lever arm 236 is, in large measure, similar to the first lever arm 36 described above in the first illustrated embodiment. Therefore, a detailed description will not be provided. The operation of the second alternative electrical junction box 210 is also similar to the electrical junction box 10, with the exception that only a single lever arm 236 is provided.

Figure 21:
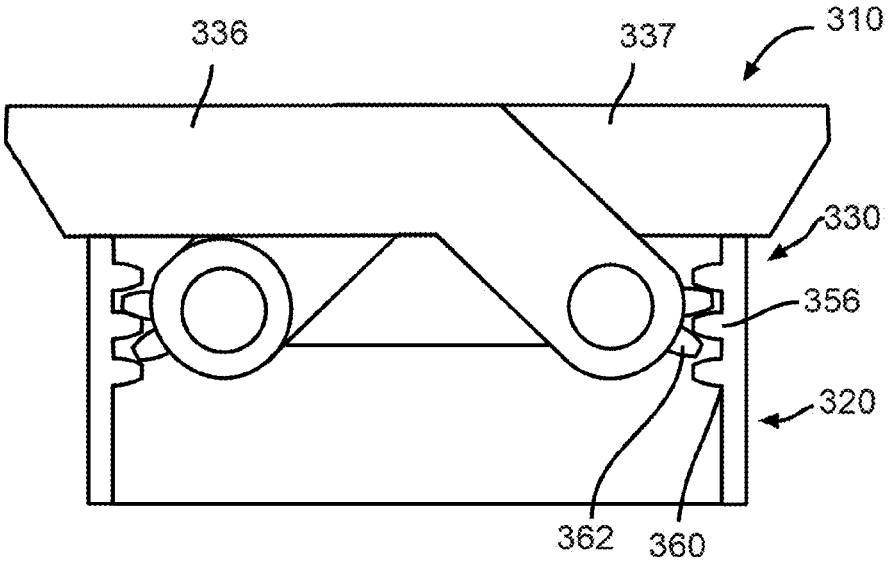
FIG. 21 is a side elevational view of a third alternative electrical junction box shown in an assembled position. The third alternative electrical junction box includes a rack and pinion system to assemble the electrical junction box.
Figure 22:
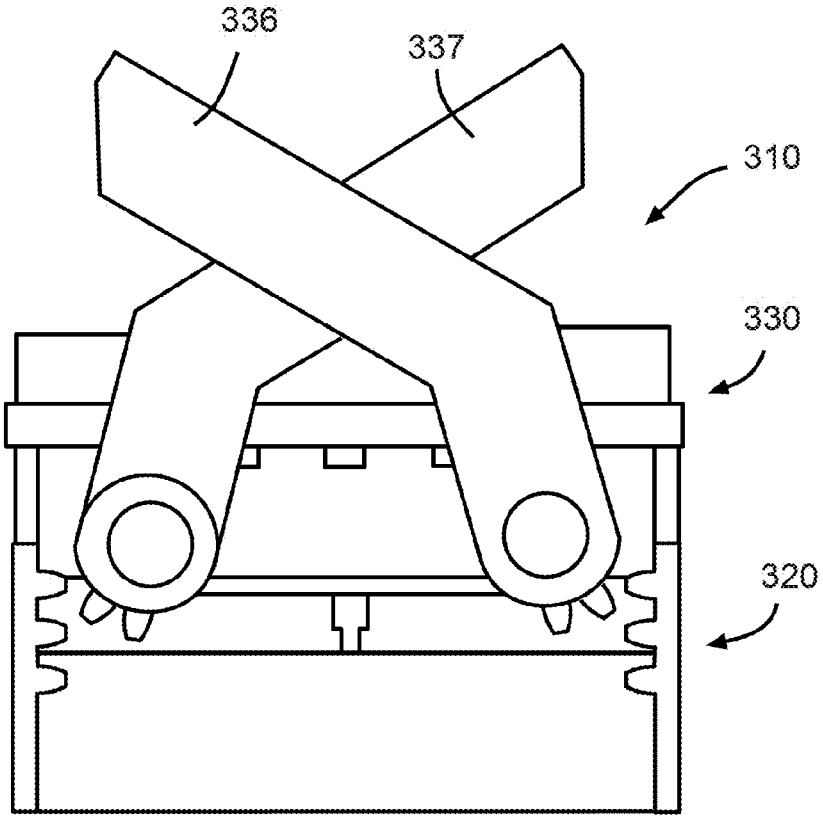
FIG. 22 is a side elevational view of the electrical junction box of FIG. 21 shown in a partially assembled position.

Referring now to FIGS. 21 and 22, there is illustrated a third alternative electrical junction box, indicated generally at 310, in accordance with a fourth illustrated embodiment. The third alternative electrical junction box 310 may include any structural features as described and illustrated above in the previous embodiments, although such is not required. Similar features have been numbered with common reference numerals but have been increased by 300 (e.g. 320, 330, 340, etc.). It should be appreciated that similar features are structured similarly, operate similarly, and/or have the same function unless otherwise indicated by the drawings or this specification.

The illustrated third alternative electrical junction box 310 includes a connector retainer assembly 320 and a connector housing assembly 330. The connector housing assembly 330 further includes a first lever arm 336 and a second lever arm 337. The first lever arm 336 and the second lever arm 337 are supported for pivotal movement on the connector housing assembly 330 in a crossing configuration, as previously described. The third alternative electrical junction box 310 includes a rack and pinion gear system 356 for engaging and disengaging the connector housing assembly 330 and the connector retainer assembly 320. The connector retainer assembly 320 includes a gear rack 360 that extends along a side wall thereof. The proximal end of the first lever arm 336 includes pinion gears 362, respectively. In operation, when the first lever arm 336 and the second lever arm 337 are pivoted from a raised position (as shown in FIG. 22) to a lowered position (as shown in FIG. 21), the pinion gears 362 mesh with the gear racks 360 to draw the connector housing assembly 330 into mating engagement with the connector retainer assembly 320. It should be appreciated that the gear racks 360 and the pinion gears 362 may be configured in any desired manner to accomplish the desired functions.

The principle and mode of operation of this invention have been explained and illustrated in the embodiments. However, it must be understood that this invention may be practiced otherwise than as specifically explained and illustrated without departing from its spirit or scope.

What is claimed is:

1. An electrical junction box comprising:

a connector retainer assembly having a latch pin extending outward therefrom, the latch pin defining a contact surface; and a connector housing assembly including a pivotal lever arm having a first end and a second end pivotally attached to the connector housing assembly, the second end of the lever arm having a cam slot formed therein, the cam slot defining an engagement surface;

wherein the connector retainer assembly and the connector housing assembly are configured so that when the lever arm is moved in a single motion in a single direction relative to the connector housing assembly, the engagement surface engages the contact surface and moves the connector housing assembly from a pre-staged position relative to the connector retainer assembly to an assembled position relative to the connector retainer assembly;

wherein in the pre-staged position the lever arm and the latch pin are positioned such that the latch pin is outside of the cam slot and spaced apart from the engagement surface, and wherein in the assembled position the lever arm and the latch pin are positioned such that the latch pin is within the cam slot.

2. The electrical junction box of claim 1, further comprising: a plurality of electrical terminals mounted on the connector retainer assembly, and a circuit board assembly connected to the connector housing assembly;

wherein when the connector housing assembly is in the pre-staged position relative to the connector retainer assembly, the electrical terminals are not mated with the circuit board assembly, and when the connector housing assembly is in the assembled position relative to the connector retainer assembly, the electrical terminals are mated with the circuit board assembly.

3. The electrical junction box of claim 2, wherein the lever arm is a first lever arm, the connector housing assembly includes a pivotally connected second lever arm, and the first lever arm and the second lever arm are arranged in a crossing configuration.

4. The electrical junction box of claim 1, wherein the lever arm further has a removal surface, and wherein the connector retainer assembly and the connector housing assembly are further configured so that when the lever arm is moved in a single second direction relative to the connector housing assembly, the removal surface engages the contact surface and moves the connector housing assembly from the assembled position relative to the connector retainer assembly to the pre-staged position relative to the connector retainer assembly.

5. The electrical junction box of claim 4, further comprising:

a plurality of electrical terminals mounted on the connector retainer assembly; and a circuit board assembly connected to the connector housing assembly;

wherein when the connector housing assembly is in the pre-staged position relative to the connector retainer assembly, the electrical terminals are not mated with the circuit board assembly and, when the connector housing assembly is in the assembled position relative to the connector retainer assembly, the electrical terminals are mated with the circuit board assembly.

6. The electrical junction box of claim 1, wherein the lever arm is a first lever arm and the connector housing assembly includes a pivotally connected second lever arm, wherein the first lever arm and the second lever arm are arranged in a crossing configuration.

7. The electrical junction box of claim 5, wherein one of the lever arm and the connector retainer assembly includes a gear rack, and the other of the lever arm and the connector retainer assembly includes pinion gears, and wherein the pinion gears and gear rack mesh and move relative to each other when the lever arm is pivoted relative to the connector housing assembly.

8. The electrical junction box of claim 7, wherein the lever arm is a first lever arm and the connector housing assembly includes a pivotally connected second lever arm, and wherein the first lever arm and the second lever arm are arranged in a crossing configuration.

9. An electrical junction box comprising:

a connector retainer assembly; and a connector housing assembly including a first pivotal lever arm pivotally attached to the connector housing assembly about a first pivot axis and a second pivotal lever arm pivotally attached to the connector housing assembly about a second pivot axis spaced apart from the first pivot axis, wherein the first lever arm and the second lever arm are arranged in a crossing configuration;

wherein the connector retainer assembly and the connector housing assembly are configured so that when the first lever arm and the second lever arm are each moved in respective single motions about their respective pivot axes in respective single directions relative to the connector housing assembly, the connector retainer assembly moves from a pre-staged position relative to the connector retainer assembly to an assembled position relative to the connector retainer assembly.

10. The electrical junction box of claim 9, further comprising: a plurality of electrical terminals mounted on the connector retainer assembly, and a circuit board assembly connected to the connector housing assembly;

wherein when the connector housing assembly is in the pre-staged position relative to the connector retainer assembly, the electrical terminals are not mated with the circuit board assembly, and when the connector housing assembly is in the assembled position relative to the connector retainer assembly, the electrical terminals are mated with the circuit board assembly.

11. An electrical junction box comprising:

a connector retainer assembly;

a connector housing assembly;

a first lever arm pivotally connected to the connector housing assembly about a first pivot axis;

a second lever arm pivotally connected to the connector housing assembly about a second pivot axis spaced apart from the first pivot axis, wherein the first lever arm and the second lever arm are arranged in a crossing configuration;

a plurality of electrical terminals mounted on the connector retainer assembly; and a circuit board assembly connected to the connector housing assembly; wherein the connector retainer assembly and the connector housing assembly configured so that when the first lever arm and the second lever arm are each moved in respective single motions in respective single directions relative to the connector housing assembly, the connector housing assembly moves from a pre-staged position relative to the connector retainer assembly to an assembled position relative to the connector retainer assembly;

when the connector housing assembly is in the pre-staged position relative to the connector retainer assembly, the electrical terminals are not mated with the circuit board assembly; and when the connector housing assembly is in the assembled position relative to the connector retainer assembly, the electrical terminals are mated with the circuit board assembly.

* * * * *